United States Patent [19]

Davis

[11] Patent Number: 4,917,622

[45] Date of Patent: Apr. 17, 1990

[54] STRAIN RELIEF DEVICE FOR ELECTRICAL CABLES

[75] Inventor: Randall D. Davis, Machesney Park, Ill.

[73] Assignee: Sundstrand Corporation, Rockford, Ill.

[21] Appl. No.: 377,163

[22] Filed: Jul. 10, 1989

[51] Int. Cl.[4] ..... H01R 13/58; H01R 13/52

[52] U.S. Cl. ..... 439/271; 439/275; 439/465

[58] Field of Search ..... 439/465–467, 439/687, 696, 906, 274, 275, 470, 471, 271

[56] References Cited

U.S. PATENT DOCUMENTS

| | | | |
|---|---|---|---|
| 3,181,105 | 4/1965 | Roach et al. | 439/275 |
| 3,187,292 | 6/1965 | Small et al. | 439/275 |
| 3,603,913 | 9/1971 | Hasty, Jr. | 439/471 |
| 3,622,942 | 11/1971 | Rynk | 439/471 |
| 3,638,169 | 1/1972 | Caveney et al. | 439/471 |
| 4,108,527 | 8/1978 | Douty et al. | 439/465 |
| 4,422,706 | 12/1983 | Neuhouser | 439/465 |

FOREIGN PATENT DOCUMENTS

| | | | |
|---|---|---|---|
| 1046811 | 10/1983 | U.S.S.R. | 439/466 |

*Primary Examiner*—Gary F. Paumen

*Attorney, Agent, or Firm*—Wood, Phillips, Mason Recktenwald & Vansanten

[57] ABSTRACT

The problem of preventing breakage of the terminating connections of electrical wires (32) is solved by a strain relief device (12) adapted for use with an electrical connector (10) for terminating a multi-wire electrical cable (18). The strain relief device includes a pair of shell members (34) adapted for assembly to a terminating end of the electrical connector and for embracing the electrical cable. A first groove (36) is formed about the outside of the shell members when in assembly. A locking ring (38) is positionable in the first groove to hold the shell members in assembly on the electrical connector. A second groove (40) is formed on the inside of the assembled shell members. A clam;ing ring (42) is positionable in the second groove for clamping about the electrical cable when the shell members are held in assembly by the locking ring. A third groove (46) is formed on the inside of the assembled shell members for receiving an outwardly projecting flange (48) at the terminating end of the electrical connector to position the shell members in assembly on the connector. The connector and the shell members combine to define a fourth groove (49) on the outside of the assembly for receiving a sealing O-ring (26) for positioning within an opening (14) in an appropriate housing (16).

24 Claims, 1 Drawing Sheet

STRAIN RELIEF DEVICE FOR ELECTRICAL CABLES

FIELD OF THE INVENTION

This invention generally relates to the art of electrical cable termination and, particularly, to a strain relief device adapted for use with an electrical connector for terminating an electrical cable.

BACKGROUND OF THE INVENTION

There are a wide variety of strain relief devices for protecting the termination points between the electrical wires of an electrical cable and the contacts of an electrical connector by relieving the strain which might be applied on the composite electrical cable. Such devices can range from ordinary clamp members used with coaxial cables to sophisticated mechanisms formed integral with a complicated connector structure.

There are various applications where an electrical wiring harness (i.e. a multi-connector prewired system) is used in an apparatus for establishing its desired electrical circuitry network. One such application is in the area of integrated drive generators which include a housing structure within which the generator components, along with the electrical harness, are contained. The harness includes a plurality of terminating connectors which are "slipped through" the housing so that terminating ends of the connectors are exposed on the outside of the housing for connection to appropriate mating connectors. In other words, the entire electrical harness is disposed within the housing, with only the mating connector ends of the connectors exposed through holes in the housing.

With such integrated drive generators, the housing usually is constructed of a main input housing within which the major components of the generator are secured, along with a housing cover, such as an end cover secured and sealed to the main input housing. The electrical harness is disposed within the housing with some of the electrical connectors slipped through holes in the main housing and other of the harness connectors slipped through holes in the housing cover.

During assembly, there are little or no problems involved in securing the harness connectors through and to the holes in the main generator housing while the assembly is in open condition. The electrical cables are appropriately secured and when in place there is little or no movement of the electrical cables relative to their connectors or the main input housing itself. Consequently, there is very little chance for the connections between the wire ends of the cables and the contacts of the connectors being disturbed.

However, a different situation arises where one or more of the connectors must be slipped through and secured to a hole in the housing cover. This must be done prior to assembling the housing cover to the main input housing. Consequently, a length of the harness cable or wiring usually "hangs loose" from the inside of the housing cover when the respective connector is secured in place. This is necessary because, by the mere nature of such an assembly procedure, internal access for clamping and retaining the last few inches of the wiring harness is not possible once the housing portions are assembled. Therefore, the electrical cable as well as the wiring to the connector contacts, are allowed to move both during assembly and operation.

This relative movement results in broken wires at the solder joint connections between the wires and the contacts due to inadequately retained lead wires which are allowed to move during assembly and operation. This invention is directed to solving such problems and satisfying the need for an improved strain relief device particularly adapted for slip-through type electrical connector arrangements of the character described

SUMMARY OF THE INVENTION

An object, therefore, of the invention is to provide a new and improved strain relief device for electrical cables and adapted for use with an electrical connector which terminates the cables.

In the exemplary embodiment of the invention, at least a pair of shell members are adapted for assembly to a terminating end of the electrical connector and for embracing the electrical cable. Generally, first receptacle means are provided on the outside of the shell members. Retaining means are positionable in the first receptacle means for holding the shell members in assembly on the electrical connector. Second receptacle means are provided on the inside of the shell members. Strain relief means are positionable in the second receptacle means for clamping about the electrical cable when the shell members are held in assembly by the retaining means.

More particularly, the first receptacle means is provided by a peripheral exterior groove formed on the outside of the assembled shell members, and the second receptacle means is formed by an interior groove within the assembled shell members. The retaining means is in the form of a locking ring positionable in the exterior peripheral groove, and the strain relief means is in the form of a resilient clamping ring positionable in the interior groove of the assembled shell members.

Another feature of the invention is the provision of complementary interengaging means between the shell member and the electrical connector for retaining the shell members to the electrical connector when in assembled condition, without any extraneous attaching means.

Specifically, the terminating end of the electrical connector has an outwardly projecting peripheral flange. The shell members have interior groove means for receiving the connector flange to position and retain the shell member on the terminating end of the connector when the shell members are retained in assembly.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the Figures and in which:

DETAILED DESCRIPTION OF THE PREFERRED EMBODIMENT

Figure 1:
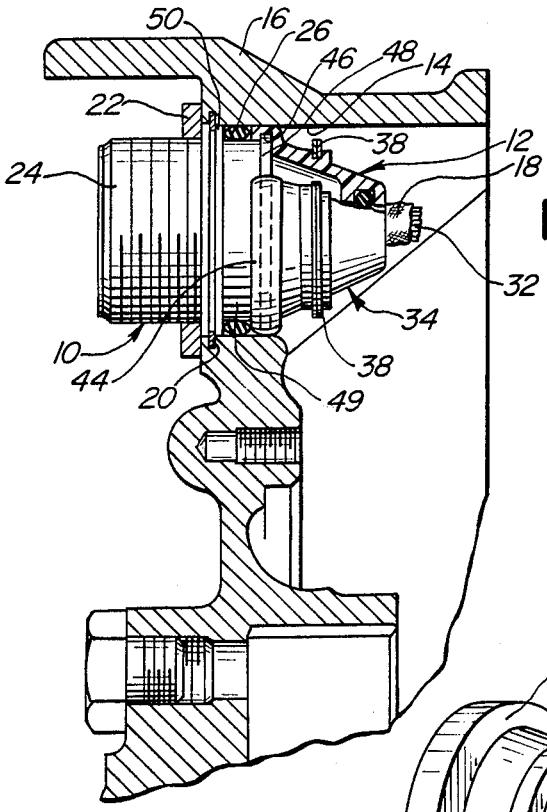
FIG. 1 is a section through a portion of a housing having a hole through which an electrical connector is positioned and incorporating the strain relief device of the invention.

Referring to the drawings in greater detail, and first to FIG. 1, an electrical connector, generally designated 10, in conjunction with a strain relief device, generally designated 12, is disposed within a hole 14 of a housing 16. As stated above, housing 16 may comprise an end cover which is assembled to another main housing structure, such as the main input housing of an integrated drive generator. Consequently, during assembly, a given length (e.g. four inches) of a multi-wire electrical cable 18 must be provided to hang loose or free from the electrical cable because, by nature of the assembly procedures of the end cover to the main housing structure, internal access for manipulating and handling the connector or wiring harness is not possible once the two housing portions are assembled.

As seen in FIG. 1, connector 10 is secured within hole 14 in housing 16 by a spiral lock or retaining ring 20 positionable within a mating groove in the housing, and a retainer plate 22 slip fit onto a mating end 24 of connector 10 and bolted (not shown) to housing 16. As described further hereinafter, an O-ring seal 26 surrounds connector 10 in sealing relationship with the walls of hole 14 in housing 16.

Figure 2:
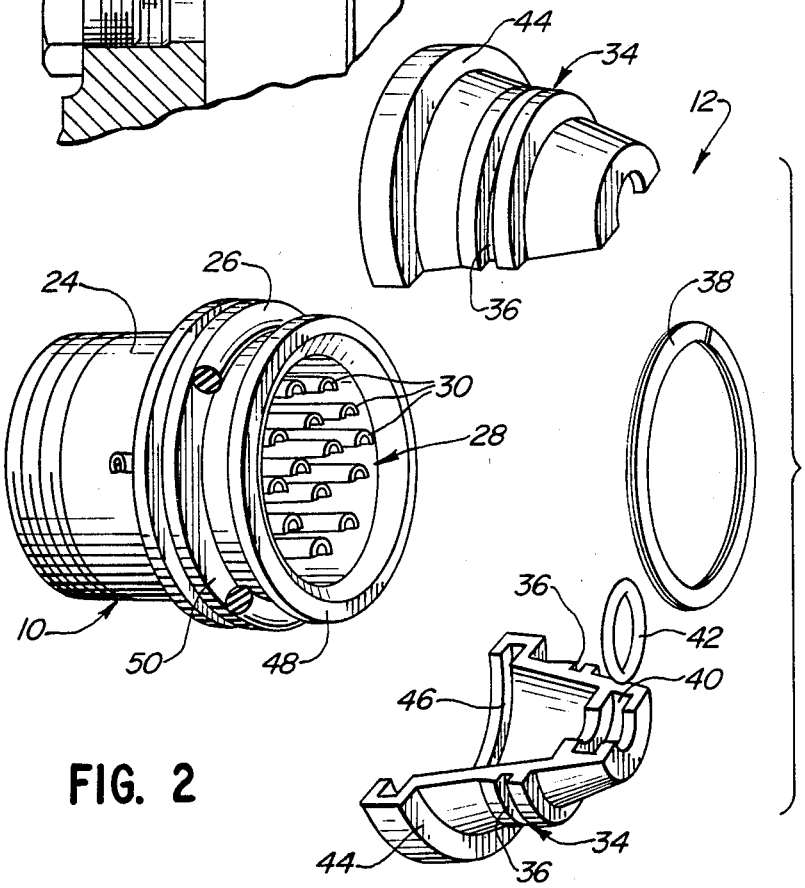
FIG. 2 is a fragmented, exploded perspective view of the electrical connector and strain relief device of FIG. 1.

Referring to FIG. 2 in conjunction with FIG. 1, connector 10 has a terminating end, generally designated 28, including a plurality of tubular contacts 30 to which a multiplicity of wires 32 (FIG. 1) of electrical cable 18 are terminated, as by solder connections. Without strain relief device 12, these solder connections are prone to breakage during the aforementioned assembly procedures or during operation of the generator.

Strain relief device 12 includes a pair of shell members or mating halves, generally designated 34, adapted for assembly to terminating end 28 of connector 10 and for embracing electrical cable 18, as described hereinafter.

Specifically, each shell half 34 has first receptacle means in the form of an exterior peripheral groove which, when the two shell halves are assembled, form a circular groove 36 completely about the strain relief device. The groove provides receptacle means for an expandable retaining means in the form of a spiral locking ring 38 which is positionable within the groove, as shown in FIG. 1, to hold the shell halves together and assembled to the terminating end 28 of electrical connector 10.

Strain relief shell halves 34 also have interior grooves 40 which, when the shell halves are assembled together, form an interior circular groove surrounding cable 18. Grooves 40 combine to provide second receptacle means on the inside of the assembled shell halve for receiving a resilient O-ring 42 which clamps about electrical cable 18 when the shell halves are held in assembly by locking ring 38. This provides a clamping strain relief force against the cable. In essence, outside ring 38 forms a locking ring for the assembled shell halves, and inside ring 42 forms a clamping ring about cable 18.

Shell halves 34 further have enlarged diameter portions 44 forming second interior grooves 46 which, when the shell halves are assembled, provide means for retaining the strain relief device onto the terminating end of electrical connector 10. To this end, terminating end 28 of the electrical connector has an outwardly projecting circular flange 48 for snugly positioning within interior groove 46 defined by the assembled shell halves 34. The assembled condition of strain relief device 12 on the terminating end of connector 10 is shown in FIG. 1, with connector flange 48 positioned within groove 46 of the shell halves.

An important factor in designing components for aircraft or aerospace application, is the requirement of reducing the size and weight parameters of the components. With the structure described immediately above, it can be seen best in FIG. 1 that the enlarged portions 44 of shell halves 34 define one side of a groove 49 for receiving sealing O-ring 26, and a flange 50 projecting outwardly about connector 10 defines the opposite side of the O-ring groove. Heretofore, such O-ring grooves were formed exclusively by the electrical connector itself With the described design of the strain relief device of the invention, the inner end of the strain relief device which provides means for securing the shell halves to the connector also serves as one of the engaging sides of the O-ring groove, thereby shortening the dimensions of the combined or overall package of the electrical connector and associated strain relief device.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A strain relief device adapted for use with an electrical connector for terminating an electrical cable, comprising:

at least a pair of shell members adapted for assembly to a terminating end of the electrical connector and for embracing the electrical cable;

first receptacle means in the form of a groove extending substantially entirely about the periphery of the sheel members;

retaining means positionable in the first receptacle means for holding the shell members in assembly on the electrical connector;

second receptacle means on the inside of the shell members; and strain relief means positionable in the second receptacle means for clamping about the electrical cable when the shell members are held in assembly by the retaining means.

2. The strain relief device of claim 1 wherein said retaining means comprises a locking ring positionable in the peripheral groove.

3. The strain relief device of claim 1 wherein said second receptacle means comprises an interior groove formed by the assembled shell members.

4. The strain relief device of claim 3 wherein said strain relief means comprises a clamping ring positionable in the interior groove.

5. The strain relief device of claim 1 wherein the terminating end of said electrical connector has outwardly projecting flange means, and said shell members have interior groove means for receiving the flange means to position the shell members in assembly on the electrical connector.

6. The strain relief device of claim 5 wherein one side of said interior groove means of the sidewall members is defined by inwardly projecting flange means at an end of the shell members for seating behind the outwardly projecting flange means on the electrical connector.

7. The strain relief device of claim 6 wherein said electrical connector has shoulder means spaced from the flange means at the end of the shell members and cooperating with the flange means to define a peripheral exterior groove for receiving an appropriate sealing ring.

8. A strain relief device adapted for use with an electrical connector for terminating an electrical cable, comprising:

at least a pair of shell members adapted for assembly to a terminating end of the electrical connector and for embracing the electrical cable;

a groove extending substantially entirely about the periphery of the assembled sheel members;

retaining means positionable in the groove for holding the shell members in assembly on the electrical connector;

an interior groove formed about the inside of the assembled shell members; and strain relief means positioned in the interior groove for clamping about the electrical cable when the shell members are held in assembly by the retaining means.

9. The strain relief device of claim 8 wherein said retaining means comprises a locking ring positionable in the peripheral groove.

10. The strain relief device of claim 8 wherein said strain relief means comprises a clamping ring positionable in the interior groove.

11. The strain relief device of claim 10 wherein said retaining means comprises a locking ring.

12. The strain relief device of claim 8 wherein the terminating end of said electrical connector has outwardly projecting flange means, and said shell members have a second interior groove for receiving the flange means to position the shell members in assembly on the electrical connector.

13. The strain relief device of claim 12 wherein one side of said second interior groove of the shell members is defined by inwardly projecting flange means at an end of the shell members for seating behind the outwardly projecting flange means on the electrical connector.

14. The strain relief device of claim 13 wherein said electrical connector has shoulder means spaced from the inwardly projecting flange means at the end of the shell members and cooperating therewith to define a second peripheral exterior groove for receiving an appropriate sealing ring.

15. A strain relief device in combination with an electrical connector for terminating an electrical cable, comprising:

at least a pair of shell members adapted for assembly to a terminating end of the electrical connector and for embracing the electrical cable;

first groove means extending substantially entirely about the periphery of the shell members;

retaining means positionable in the first groove means for holding the shell members in assembly on the electrical connector;

second groove means on the inside of the shell members;

strain relief means positionable in the second groove means for clamping about the electrical cable when the shell members are held in assembly by the retaining means;

third groove means on the inside of the shell members; and positioning means on the electrical connector positionable in the third groove means for retaining the shell members and, therefore, the strain relief device on the electrical connector.

16. The combination of claim 15 wherein said retaining means comprises a locking ring positionable in the first groove means.

17. The combination of claim 15 wherein said strain relief means comprises a clamping ring positionable in the second groove means.

18. The combination of claim 17 wherein said retaining means comprises a locking ring positionable in the first groove means.

19. The combination of claim 15 wherein said positioning means comprises an outwardly projecting flange on a terminating end of the electrical connector.

20. The combination of claim 15 including fourth groove means defined between the shell members and the electrical connector for receiving a sealing ring.

21. The combination of claim 20 wherein said fourth groove means is defined by an outwardly projecting flange of the electrical connector and a distal end of the assembled shell members.

22. A strain relief device in combination with an electrical connector for terminating an electrical cable, comprising in combination:

a sealing O-ring means about the outer periphery of the electrical connector for defining one side of a groove for receiving the sealing O-ring; and means about the strain relief device defining an opposite side of the groove for receiving the O-ring.

23. The combination of claim 22 wherein a terminating end of said electrical connector has first outwardly projecting flange means defining said one side of the groove and second outwardly projecting flange means spaced from the first flange means, and said strain relief device has an interior groove for receiving the second flange means of the electrical connector.

24. The combination of claim 23 wherein said strain relief device includes inwardly projecting flange means at an end thereof for seating over the second flange means of the electrical connector and defining said opposite side of the O-ring groove.

* * * * *